US005344152A

United States Patent [19]

Brannen

[11] Patent Number: 5,344,152

[45] Date of Patent: Sep. 6, 1994

[54] GOLF SWING TRAINING DEVICE

[76] Inventor: Thomas W. Brannen, 12485 Preserve La., Alpharetta, Ga. 30201

[21] Appl. No.: 100,412

[22] Filed: Aug. 2, 1993

[51] Int. Cl.[5] ..... A63B 69/36

[52] U.S. Cl. ..... 273/189 R

[58] Field of Search ..... 273/189 R, 189 A, 187.2

[56] References Cited

U.S. PATENT DOCUMENTS

| | | | |
|---|---|---|---|
| 2,093,153 | 9/1937 | McCarthy | 273/35 |
| 4,688,800 | 8/1987 | Lopez | 273/189 R X |
| 4,743,028 | 5/1988 | Harrison | 273/183 |
| 4,917,385 | 4/1990 | Brown | 273/187 B |
| 5,076,587 | 12/1991 | Manley | 273/183 |

*Primary Examiner*—George J. Marlo
*Attorney, Agent, or Firm*—Dowell & Dowell

[57] ABSTRACT

A golf swing training device for limiting movement of a golfer's following forearm with respect to the following upper arm during a backswing includes a base portion which is positionable on the bicep of a golfer's upper arm adjacent to the elbow and a fastener for securing the device at a fixed position. A wall extends upwardly from the front end of the base portion to form a substantially L-shaped configuration. The wall contacts and prevents further bending of the golfer's forearm at the top of the backswing so that the angle formed between the forearm and the upper arm is approximately 90 degrees at this position.

9 Claims, 2 Drawing Sheets

GOLF SWING TRAINING DEVICE

BACKGROUND OF THE INVENTION

1. Field of the Invention

This invention relates to a golf swing training device, and, more particularly, to a training device which is positionable on a golfer's following arm and contacts and limits movement of a golfer's forearm relative to the following upper arm during a backswing. The device prevents bending of the following arm elbow by more than 90 degrees and consequently causes the leading arm to remain straight.

2. Discussion of the Related Art

When swinging a golf club, and especially during the backswing, it is important for several reasons to control the movement of the following or power arm relative to the upper body. The following arm is the right arm for a golfer using a right handed club, and the left arm for a golfer using a left handed club. It is first important to properly position the following arm with respect to the golfer's body during the backswing to achieve maximum control and power of the head of the golf club. Improper positioning of the following arm results in erratic golf shots which significantly diminish the level and consistency of the golfer's game, and prevents the golfer from reaching his or her potential.

U.S. Pat. No. 4,743,028 to Harrison discloses a golf swing practice device which is directed to this problem. The device monitors the position and movement of the golfer's power arm with respect to the body during a golf swing. The swing practice device comprises an indicator which provides an audio or visual signal when the power arm moves away from the body by more than a predetermined distance.

A second problem associated with the movement of the following arm during a swing is bending of the following forearm with respect to the following upper arm by more than about 90 degrees during the backswing. Bending of the following arm elbow by more than 90 degrees necessarily causes bending of the leading arm elbow. Such bending is undesirable because the head of the golf club is misdirected during the forward portion of the swing and fails to strike the golf ball squarely. As a result, and the golf shot is projected toward some unintended location.

U.S. Pat. No. 5,076,587 to Manley discloses a golf club swing training brace for overcoming this problem which monitors the bend angle of the following arm elbow during a golf swing. The swing training brace comprises elongate upper arm and forearm components which are mutually connected by a pivot including an angle setting adjuster which abuts the upper arm component during a swing. The upper arm component, the forearm component, and the angle setting adjuster are each constructed of a rigid material which resists bending during the swing. The brace can be adjusted by manipulating the angle setting adjuster to limit the maximum bend of the following arm elbow to a preset angle to simulate a proper golf swing technique.

While the Manley swing training brace reduces the problem of excessive bending of the following forearm with respect to the following upper arm during the backswing, it is inadequate for several reasons. First, it is cumbersome to wear because it is large and extends along substantially the entire length of the golfer's following arm. In addition to it being unnecessarily large, it is also uncomfortable to wear because the upper arm and forearm components are rigid and limit the golfer's flexibility and consequently make it difficult to achieve a proper form during the swing. Third, the swing training brace upper arm and forearm components are sized to fit an average sized golfer. Accordingly, the brace would poorly fit golfers either much larger or smaller than the average size, and thus its usefulness is limited to a reduced number of golfers.

SUMMARY OF THE INVENTION

The present invention has been made in view of the above-described inadequacies of the related art and has as an object to provide a golf swing training device which limits movement of the following forearm with respect to the following upper arm during a backswing. The training device is relatively small and lightweight so that it is comfortable to wear and does not hamper the form of the golfer's swing.

It is another object of the present invention to provide a golf swing training device which is sized so that it comfortably fits all golfers.

Additional objects and advantages of the present invention will become apparent from the description which follows, considered in conjunction with the drawing figures, or by practice of the invention.

To achieve the objects of the invention, as embodied and broadly described herein, the swing training device of the present invention includes a swing limiting portion which is configured to be positionable on the biceps of a golfer's upper arm adjacent to the elbow so that it contact the golfer's forearm at the top of the backswing and limits the degree of bending between the forearm and the upper arm. The swing training device further includes a fastener attached to the swing limiting structure for securing the device at the proper position on the golfer's upper arm.

DETAILED DESCRIPTION OF THE PREFERRED EMBODIMENT

Figure 1:
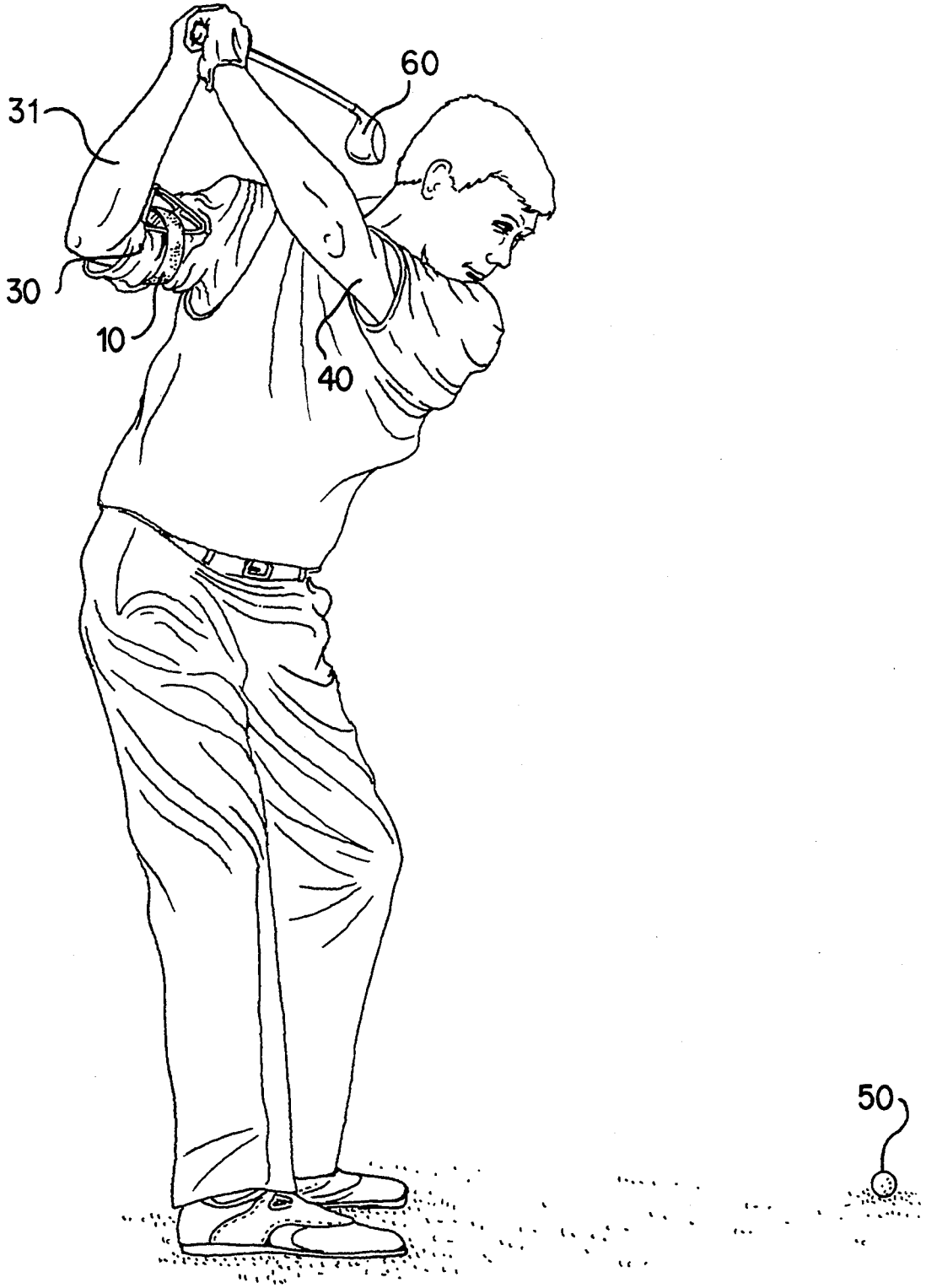
FIG. 1 is an illustrational view showing a swing training device in accordance with the present invention positioned on the following arm of a right handed golfer at the top of the backswing.

The invention will now be described in detail with reference to the drawing figures.

With reference to FIG. 1, a swing training device 10 in accordance with the present invention is illustrated secured on the right upper arm 30, or following arm, of a right handed golfer. The golfer is at the top of his backswing, and is about to begin the forward portion of the swing and strike the golf ball 50 with the head of the golf club 60.

Figure 2:
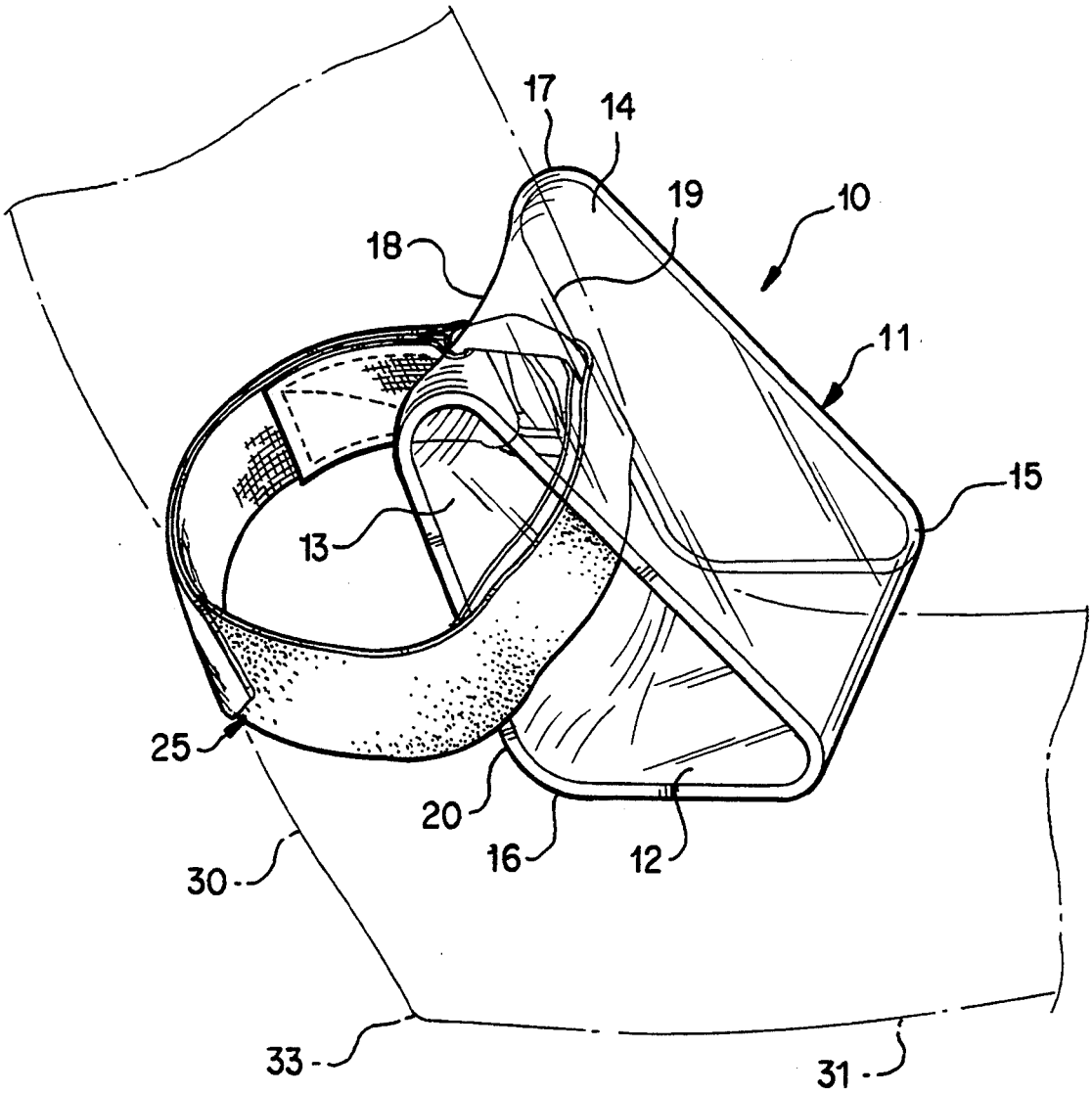
FIG. 2 is a perspective illustrational view of a swing training device in accordance with the present invention positioned on the upper arm of a golfer and contacting the forearm to prevent further bending of the elbow at the top of a backswing.

The swing training device 10 is illustrated in greater detail in FIG. 2. It comprises a limiting portion 11 which is configured to be positionable on the upper arm 30 of the following arm so as to contact the inner side of the associated forearm 31 at the top of the golf swing so that the angle formed between the upper arm and forearm is preferably about 90 degrees at that moment.

As embodied herein, the limiting portion 11 preferably has a unitary construction and comprises a forward wall 12, a base 13 which extends from the forward wall and is approximately perpendicular thereto, and a supporting wall 14 which extends between ends of the forward wall and base. The supporting wall is provided to prevent bending of the forward wall about the base when the forward wall contacts the forearm. This assures that overbending of the forearm can not occur.

The limiting portion illustrated in FIG. 2 has three sides and a generally right triangular shape, with the support wall forming the hypotenuse of the triangle. It may, however, optionally have other shapes such as rectangular so long as the forward wall is approximately perpendicular to the base. The corners 15, 16 and 17 are each preferably rounded so that the golfer's arm is not exposed to sharp edges.

The base 13 includes a concave portion 18 which extends along its entire length and is located intermediate its side edges 19 and 20. The concave portion is shaped to be positionable on the biceps of the following arm of the golfer. For a right-handed golfer, the following arm is the right arm as shown in FIG. 1, and it is the left arm for a left-handed golfer.

The swing training device in accordance with the present invention preferably is composed of a lightweight plastic material which is clear and capable of being molded to form a unitary structure. The plastic may optionally be provided in various colors.

In accordance with the invention, the swing training device 10 further comprises a securing strap 25 which is attached to the base 13 for securing the limiting portion 11 at the proper position on the golfer's upper arm. As embodied herein, the securing strap preferably includes a hook and loop-type fastening material such as "VELCRO" TM which is attached to opposite faces of the base by an adhesive. Other conventional types of adjustable securing straps may optionally be used.

In operation during a golf swing training session, the swing training device 10 is positioned on the following upper arm so that the concave portion 18 fits on the biceps and the forward wall 12 is located adjacent to the elbow 33. The swing training device is then secured in this position by the fastening strap 25.

After the golfer begins his swing and reaches the top of the backswing, as is illustrated in FIG. 1, the forearm 31 abuts the forward wall 12 and prevents the following arm elbow from bending any further. At this position, the angle formed between the forearm and the upper arm is approximately 90 degrees as shown in FIG. 2.

By preventing the forearm from bending further toward the upper arm, the swing training device essentially eliminates any simultaneous undesired bending of the elbow of the left or leading arm 40. This is because when the following forearm and upper arm form a relative angle of approximately 90 degrees at the top of the backswing, the leading arm is caused to remain extended and substantially straight. In contrast, when the swing training device of the invention is not worn by a golfer, overbending of the following arm forearm occurs and the angle between the forearm and upper arm is less than 90 degrees. This overbending with respect to the following arm causes the leading arm to bend also. Consequently, the head of the golf club does not travel through the intended path during the remainder of the swing and the golf ball is not hit squarely on. As a result, the shot is not projected in the intended direction.

The swing training device in accordance with the present invention thus improves the golfer's swing by preventing undesired bending of the leading arm. In training sessions, it encourages the golfer during each practice swing to reach the proper stance at the top of the backswing.

Contact between the device and the forearm provides a physical indication to the golfer that the forearm has reached its proper extent of bending. By repeatedly practicing his or her swing while wearing the training device, the golfer will eventually begin to automatically reach the proper position with each swing without even being aware of the presence of the swing training device on the arm. When the golfer reaches this point, he or she will be able to golf without wearing the swing training device and improve their golf game significantly.

The swing training device in accordance with the invention is especially useful for inexperienced golfers. It encourages these golfers to learn the proper swing form when they first begin to play the game, and thus discourages them from developing bad forms with respect to their swings. The swing training device is also quite useful for preparing golfers for early season outings. It allows golfers to regain their previous season form before any actual games are played. In all instances, its small size and light weight make it comfortable to wear and highly versatile, and assure that it does not hamper any golfer's swing.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims, and their equivalents.

What is claimed is:

1. A golf swing training device suitable for being positioned on an upper arm of a golfer to limit the degree of bending of the forearm relative to the upper arm during a golf swing, the device comprising:

a base portion including a rear end, a forward end, a pair of opposed side edges, an upper surface and a lower surface, said lower surface including a concave portion intermediate said side edges and being positionable on the golfer's bicep;

a forward wall extending upwardly from said upper surface of said base portion at said forward end, said forward wall and said base portion forming a substantially L-shaped configuration, said forward wall being adapted to contact the golfer's forearm during the golf swing; and a strap attached to said base portion and fastening means for securing said strap about the upper arm.

2. The golf swing training device of claim 1, wherein said forward wall and said base portion form an angle of approximately 90° therebetween.

3. The golf swing training device of claim 2, wherein said concave portion extends substantially along the length of said base portion and defines a longitudinal axis forming an angle of approximately 90° relative to said forward wall.

4. The golf swing training device of claim 1, wherein said forward wall includes an upper end, and the device further comprises a supporting wall connecting said rear end of said base portion to said upper end.

5. The golf swing training device of claim 4, wherein said strap is attached to said upper surface of said base portion intermediate said rear and forward ends.

6. The golf swing training device of claim 4, wherein said base portion, forward wall and connecting wall form a generally right triangular configuration.

7. A golf swing training device suitable for being positioned on an upper arm of a golfer to limit the degree of bending of the forearm relative to the upper arm during a golf swing, the device comprising:

a base portion including a forward end, a rear end, a pair of opposed side edges, an upper surface and a lower surface, said lower surface defining a concave portion intermediate said side edges and being positionable on the golfer's bicep;

a forward wall extending upwardly from said upper surface of said base portion at said forward end and forming an angle of approximately 90° therebetween, said forward wall being adapted to contact the golfer's forearm during a golf swing;

a supporting wall connecting said rear end of said base portion to said forward wall, said base portion, forward wall and supporting wall forming a generally right triangular configuration and defining a hollow space therebetween; and a strap attached to said base portion and fastening means for securing said strap about the upper arm.

8. The device of claim 7, wherein said concave portion extends substantially along the length of said base portion and defines a longitudinal axis forming an angle of approximately 90° relative to said forward wall.

9. The device of claim 8, wherein said strap is attached to said upper surface of said base intermediate said rear and forward ends.

* * * * *